US012478172B2

(12) United States Patent
Barnes

(10) Patent No.: US 12,478,172 B2
(45) Date of Patent: Nov. 25, 2025

(54) BELT DEVICE FOR CARRYING A HOLSTER

(71) Applicant: Ronald Barnes, Madison, GA (US)

(72) Inventor: Ronald Barnes, Madison, GA (US)

( * ) Notice: Subject to any disclaimer, the term of this patent is extended or adjusted under 35 U.S.C. 154(b) by 125 days.

(21) Appl. No.: 18/522,406

(22) Filed: Nov. 29, 2023

(65) Prior Publication Data

US 2025/0169597 A1 May 29, 2025

(51) Int. Cl.
*A45F 5/02* (2006.01)
*F41C 33/04* (2006.01)

(52) U.S. Cl.
CPC ..... *A45F 5/021* (2013.01); *F41C 33/048* (2013.01)

(58) Field of Classification Search
CPC .... F41C 33/048; F41C 33/041; F41C 33/046; A47G 25/48; A47G 25/482; A47G 25/50; A41F 5/00; A41F 9/00; A45F 5/021
USPC ..... 224/587, 192–193
See application file for complete search history.

(56) References Cited

U.S. PATENT DOCUMENTS 200,293 A * 2/1878 Hayden ..... A41F 9/002 2/312
668,391 A * 2/1901 Ritter ..... A41B 3/08 24/337
698,198 A * 4/1902 Hill ..... A41F 9/00 2/337
1,651,921 A * 12/1927 Felz ..... A45C 1/04 224/587
1,747,454 A * 2/1930 Mees ..... F41C 33/0227 224/675
2,691,172 A * 10/1954 Breslow ..... A41F 9/002 2/312
2,995,282 A * 8/1961 Wells ..... A45F 5/02 224/625
3,119,117 A * 1/1964 Grubman ..... A41F 9/002 2/102
3,227,336 A * 1/1966 Dickey ..... F41C 33/0245 224/907
3,300,109 A * 1/1967 Clark ..... F41C 33/041 224/667
4,544,089 A * 10/1985 Tabler ..... F41C 33/0236 224/665

(Continued)

FOREIGN PATENT DOCUMENTS

GB 2473277 A * 3/2011 ..... A41F 9/00

*Primary Examiner* — Nathan J Newhouse
(74) *Attorney, Agent, or Firm* — The Rapacke Law Group, P.A.

(57) ABSTRACT

A belt device for carrying a holster or sheath includes a belt that partially wraps around a user's waist; wherein: the belt has first and second portions having first and second widths, respectively, and a third portion connecting the first portion to the second portion, the third portion having a third width that is smaller than the first and second widths; wherein the belt device further comprises: a first clip and a second clip fastened to the belt, wherein the first clip and the second clip attach onto a waistband; a first piece of material positioned between the first clip and the belt; a second piece of material positioned between the second clip and the belt, wherein the first and second pieces of material are positioned at least partially over the first and second clips, respectively; and wherein the third portion receives and supports at least a holster clip.

20 Claims, 6 Drawing Sheets

(56) References Cited

U.S. PATENT DOCUMENTS

| | | | | |
|---|---|---|---|---|
| 4,667,374 | A * | 5/1987 | Bianchi | A44B 99/00 24/3.9 |
| 6,402,001 | B1 * | 6/2002 | Madarang | F41C 33/0245 224/198 |
| 9,267,760 | B2 * | 2/2016 | Slinkard | F41C 33/0227 |
| 10,794,664 | B1 * | 10/2020 | Moreno | F41C 33/046 |
| 2008/0061098 | A1 * | 3/2008 | Hoffner | F41C 33/046 224/661 |
| 2014/0027486 | A1 * | 1/2014 | McGee | F41C 33/045 224/587 |
| 2014/0158733 | A1 * | 6/2014 | McDonnell | F41C 33/048 224/269 |
| 2014/0305983 | A1 * | 10/2014 | Ruiz, III | F41C 33/048 224/587 |
| 2016/0209164 | A1 * | 7/2016 | Fravala | F41C 33/048 |
| 2020/0214378 | A1 * | 7/2020 | Swan | A41F 9/007 |
| 2022/0155042 | A1 * | 5/2022 | Considine | F41C 33/0236 |

* cited by examiner

BELT DEVICE FOR CARRYING A HOLSTER

TECHNICAL FIELD

The embodiments generally relate to the field of belt devices for carrying holsters and sheaths.

BACKGROUND

Some users attach holsters directly onto their waistbands. However, a waistband cannot generally keep a holster upright during a user's movement. Moreover, a holster clip is usually only loosely attached onto a waistband, as waistbands are not commonly made to receive and support holster clips.

Some users attach holsters directly onto a traditional belt. However, such belts must be either worn with specific garments made with belt loops, and such belts are uncomfortably worn entirely around a user's waist.

SUMMARY

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

In general, the disclosed belt device for carrying a holster or sheath can include a belt that partially wraps around a user's waist; wherein: the belt has first and second portions having first and second widths, respectively, and a third portion connecting the first portion to the second portion, the third portion having a third width that is smaller than the first and second widths; wherein the belt device further comprises: a first clip and a second clip fastened to the belt, wherein the first clip and the second clip attach onto a waistband; a first piece of material positioned between the first clip and the belt; a second piece of material positioned between the second clip and the belt, wherein the first and second pieces of material are positioned at least partially over the first and second clips, respectively; and wherein the third portion receives and supports at least a holster clip.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

Figure 1A:
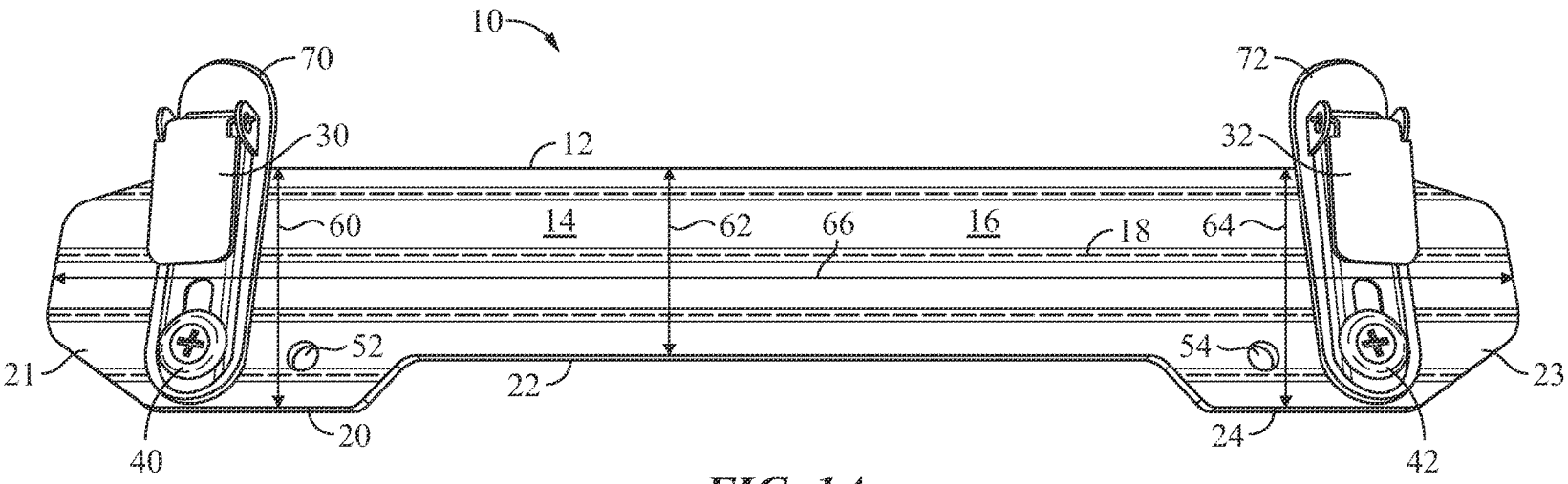
FIG. 1A illustrates an illustrative depiction of a front view of a belt device, according to some embodiments.

The drawings are not necessarily to scale, and certain features and certain views of the drawings may be shown exaggerated in scale or in schematic in the interest of clarity and conciseness.

DETAILED DESCRIPTION

The specific details of the single embodiment or variety of embodiments described herein are to the described product or methods of use. Any specific details of the embodiments are used for demonstration purposes only and no unnecessary limitations or inferences are to be understood from there.

It is noted that the embodiments reside primarily in combinations of components and procedures related to the products. Accordingly, the product and components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments described herein relate to a belt device. The belt device for carrying a holster or sheath can include a belt that partially wraps around a user's waist. The belt can have first and second portions having first and second widths, respectively, and a third portion connecting the first portion to the second portion, the third portion having a third width that is smaller than the first and second widths. The belt device is constructed and arranged to attach onto at least two locations on a waistband. The belt device can further comprise a first clip and a second clip fastened to the belt, wherein the first clip and the second clip attach onto a waistband. The belt can have a first piece of material positioned between the first clip and the belt, and a second piece of material positioned between the second clip and the belt, wherein the first and second pieces of material are positioned at least partially over the first and second clips, respectively. The third portion receives and supports at least a holster clip attached to a holster, at least a sheath clip attached to a sheath, or any combination thereof. The belt device spreads a weight of the holster or sheath across a wider area to provide stability to the holster or sheath.

In some embodiments, the belt can be waterproof or water resistant. The belt can be made primarily of a polyester or nylon webbing coated in a polymer. In some embodiments, the belt can be made primarily of BIOTHANE®. In some embodiments, the polymer can be made primarily of thermoplastic polyurethane. The first piece of material and the second piece of material can be made primarily of leather. The first clip and the second clip can be made primarily of metal. In some embodiments, the belt can be approximately 0.1 inches to 0.4 inches in thickness. The belt can be approximately 11.5 inches to 14.5 inches in length.

Referring to FIG. 1A, a belt device 10 for carrying a holster or sheath is shown. In some embodiments, the belt device 10 can include a belt 12 that is constructed and arranged to partially wrap around a user's waist (e.g., 74 in FIG. 4). The belt 12 can have a first portion 20 having a first width 60. The belt 12 can have a second portion 24 having a second width 64. The belt 12 can have a third portion 22 connecting the first portion 20 to the second portion 24. The third portion 22 can be positioned anywhere along the belt 12 between the first portion 20 and the second portion 24. The third portion 22 can have a third width 62. In some embodiments, the third width 62 can be smaller than the first width 60 and the second width 64. The third portion 22 can be constructed and arranged to receive and support at least a holster clip, at least a sheath clip, or any combination thereof.

In some embodiments, the first width 60 can be approximately 2 inches and the second width 64 can be approximately 2 inches. In some embodiments, the third width 62 can be smaller than the first width 60 and the second width 64 so that a holster clip or sheath clip can attach onto the third portion 22. In some embodiments, the third width 62 can be approximately 1.5 inches.

Figure 4:
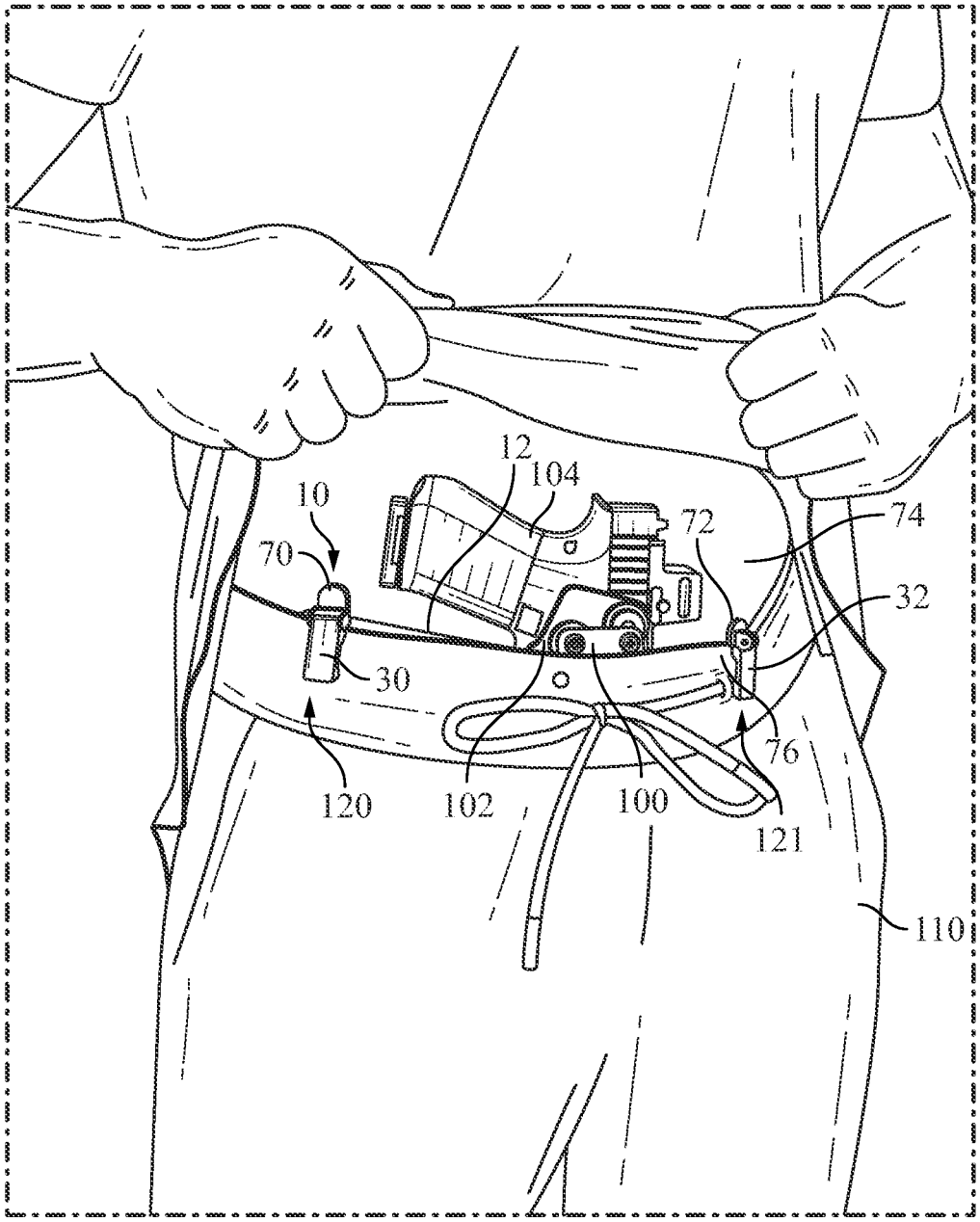
FIG. 4 illustrates an illustrative depiction of a belt device worn by a user, according to some embodiments.

The belt device 10 can include a first clip 30 fastened to the first portion 20 of the belt 12, wherein the first clip 30 is constructed and arranged to attach onto a waistband (e.g., 76 in FIG. 4). The first clip 30 can be fastened to the belt 12 by a fastener 40. The fastener 40 can be a bolt and nut fastener. A first piece 70 of material can be positioned between the first clip 30 and the belt 12. A second clip 32 can be fastened to the second portion 24 of the belt 12, wherein the second clip 32 is constructed and arranged to attach onto the waistband. The second clip 32 can be fastened to the belt 12 by a fastener 42. The fastener 42 can be a bolt and nut fastener. A second piece 72 of material can be positioned between the second clip 32 and the belt 12.

A first end 21 of the belt 12 extends beyond the first clip 30 and a second end 23 of the belt 12 extends beyond the second clip 32 to allow the belt 12 to contour away from a user's waist, which prevents the belt 12 from pushing into a user's waist when worn.

In some embodiments, at least a first side 14 of the belt 12 facing the first clip 30 and the second clip 32 can have a textured surface 16. The first side 14 of the belt 12 can have one or more grooves 18 formed along a length 66 of the belt 12.

Figure 1B:
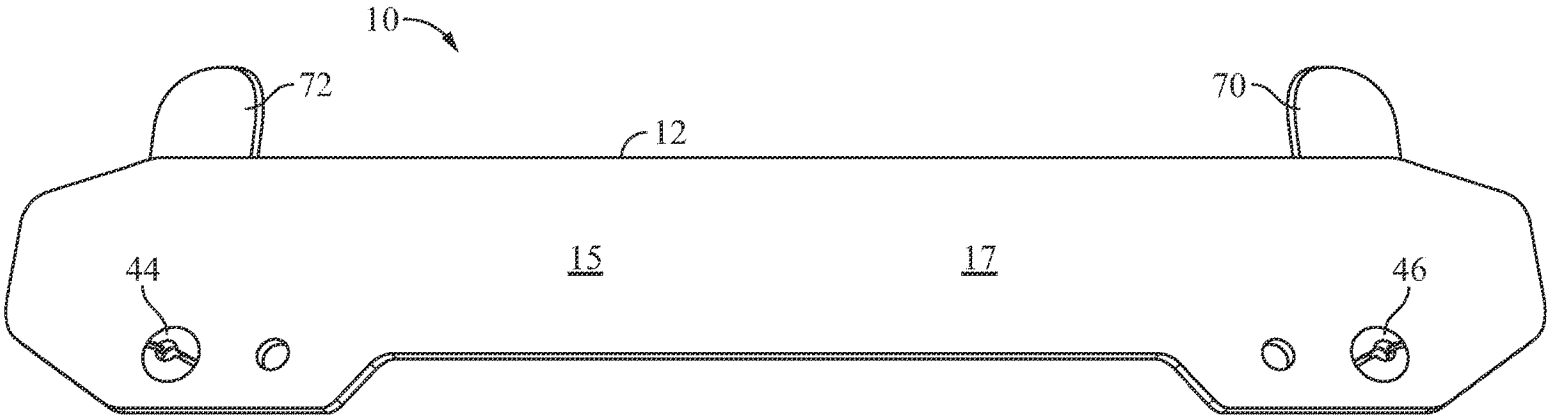
FIG. 1B illustrates an illustrative depiction of a back view of a belt device, according to some embodiments.

Referring to FIG. 1B, a second side 15 of the belt 12 facing away from the first clip 30 and the second clip 32 can have a textured surface 17. A nut 44 of the fastener 42 can be used to fasten the second clip 32 to the belt 12. A nut 46 of the fastener 40 can be used to fasten the first clip 30 to the belt 12.

Figure 1C:
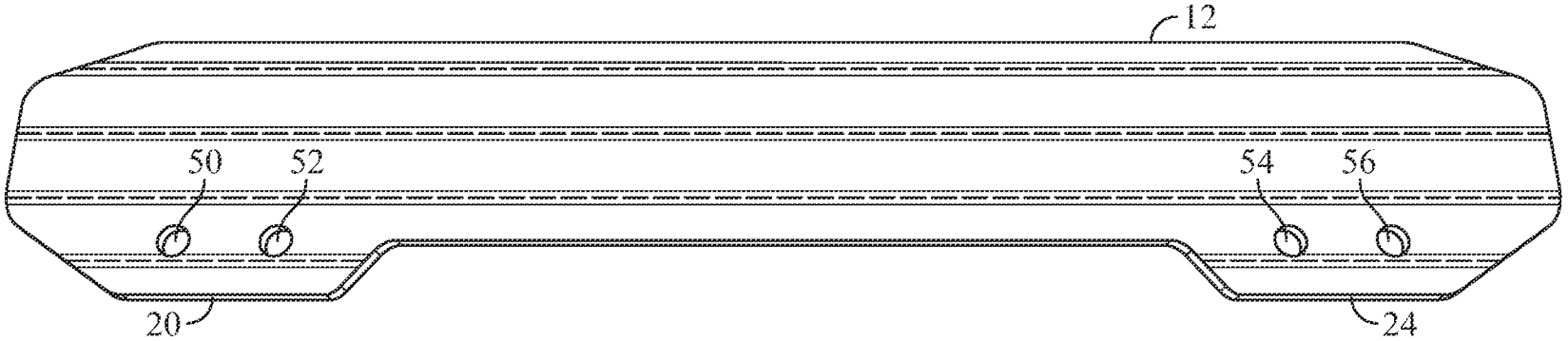
FIG. 1C illustrates an illustrative depiction of a front view of a belt device with the clips omitted, according to some embodiments.

Referring to FIG. 1C, holes 50, 52, 54, and 56 can be formed in the belt 12. Any fastener 40, 42 can be inserted through any hole 50, 52, 54, and 56 to fasten any clip 30, 32 to the belt 12.

Figure 1D:
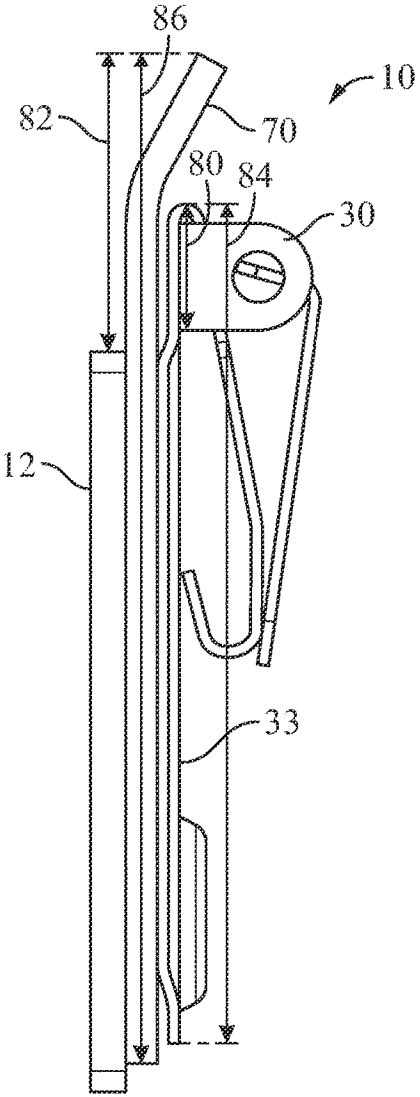
FIG. 1D illustrates an illustrative depiction of a side view of a belt device, according to some embodiments.

Referring to FIGS. 1A and 1D, in some embodiments, the first piece 70 of material can be constructed and arranged to be positioned at least partially over the first clip 30. Similarly, the second piece 72 of material can be constructed and arranged to be positioned at least partially over the second clip 32.

In some embodiments, the first clip 30 can extend above the belt 12 by a first distance 80. The first piece 70 of material can extend above the belt 12 by a second distance 82 that is larger than the first distance 80. In some embodiments, the first clip 30 can have a first height 84. The first piece 70 of material can have a second height 86 that is larger than the first height 84.

Figure 2B:
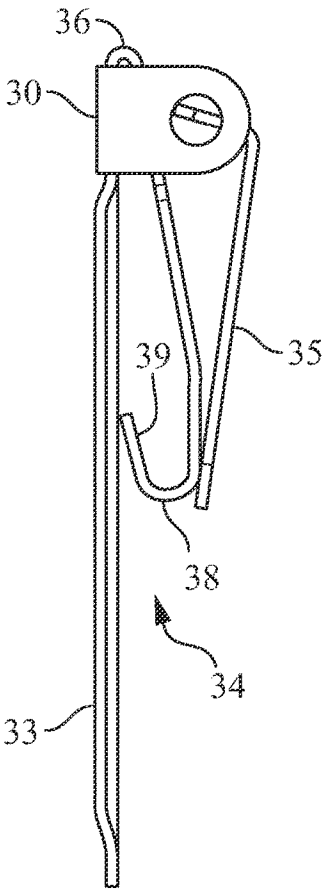
FIG. 2B illustrates an illustrative depiction of a side view of a clip of a belt device, according to some embodiments.
Figure 2A:
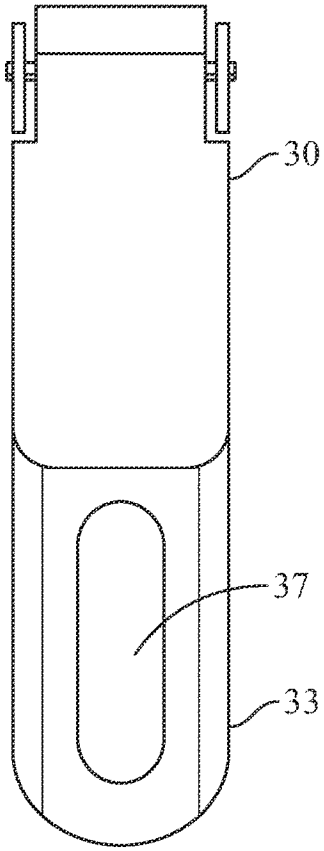
FIG. 2A illustrates an illustrative depiction of a front view of a clip of a belt device, according to some embodiments.

Referring to FIG. 2A, in some embodiments, the first clip 30 can have a plate 33 having a hole 37 for receiving a fastener 40, 42. Referring to FIG. 2B, the first clip 30 can have a first bent portion 36 that is constructed and arranged to provide tension to a jaw 34. In some embodiments, the jaw 34 can have a hook 38. An end 39 of the hook 38 can extend toward the plate 33. In some embodiments, the first clip 30 can be constructed and arranged to attach onto a waistband (e.g., 76 in FIG. 4), wherein the hook 38 prevents the first clip 30 from slipping off the waistband. A lever 35 can be used to open the jaw 34 to remove the first clip 30 from the waistband.

In some embodiments, any description of the first clip 30 is applicable to the second clip 32, and the same description need not be repeated. Similarly, any description of the first piece 70 of material is applicable to the second piece 72 of material, and the same description need not be repeated. Moreover, any number of clips and pieces of material can be included in the belt device 10.

Figure 3A:
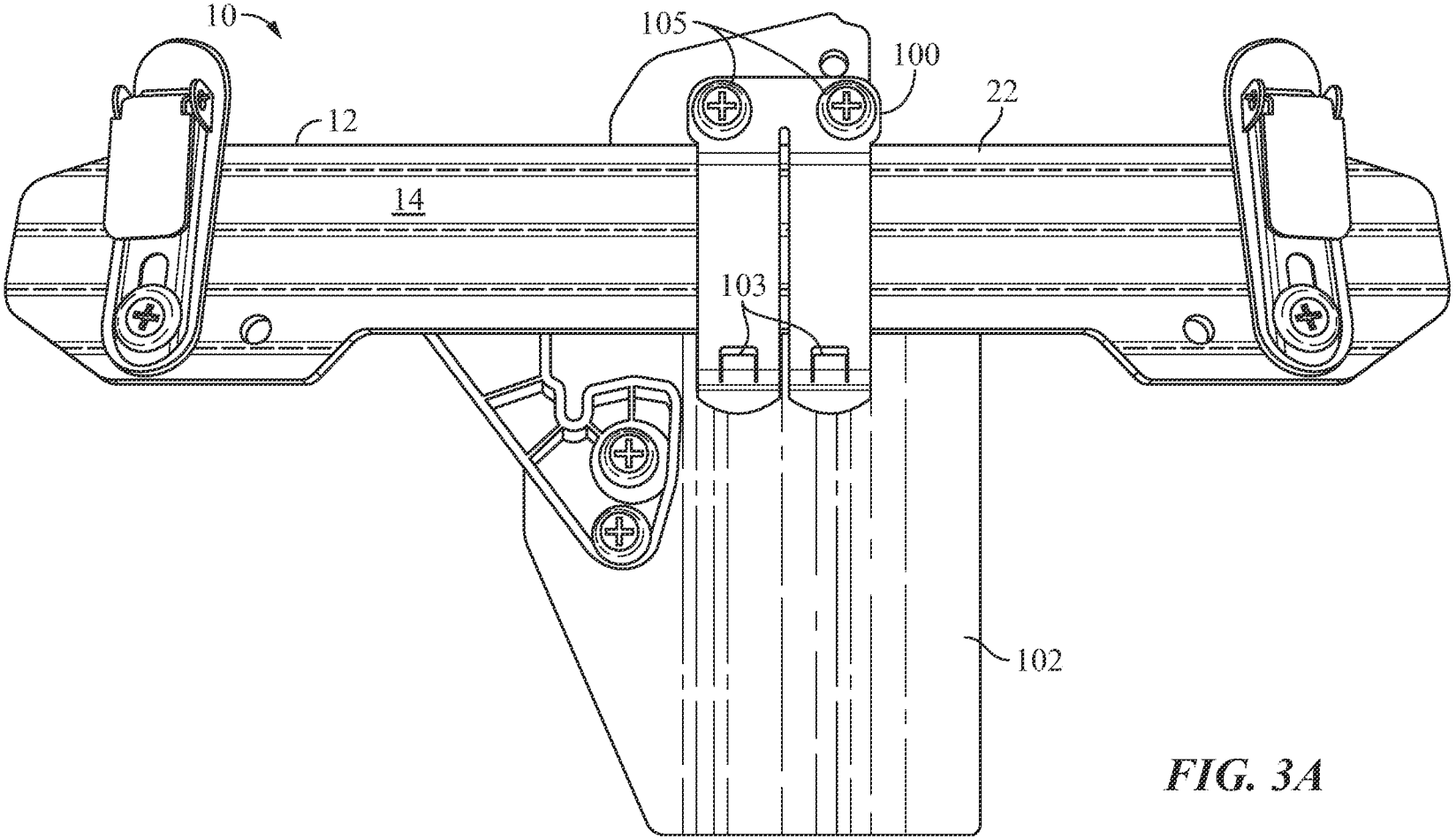
FIG. 3A illustrates an illustrative depiction of a front view of a belt device carrying a holster or sheath, according to some embodiments.
Figure 3B:
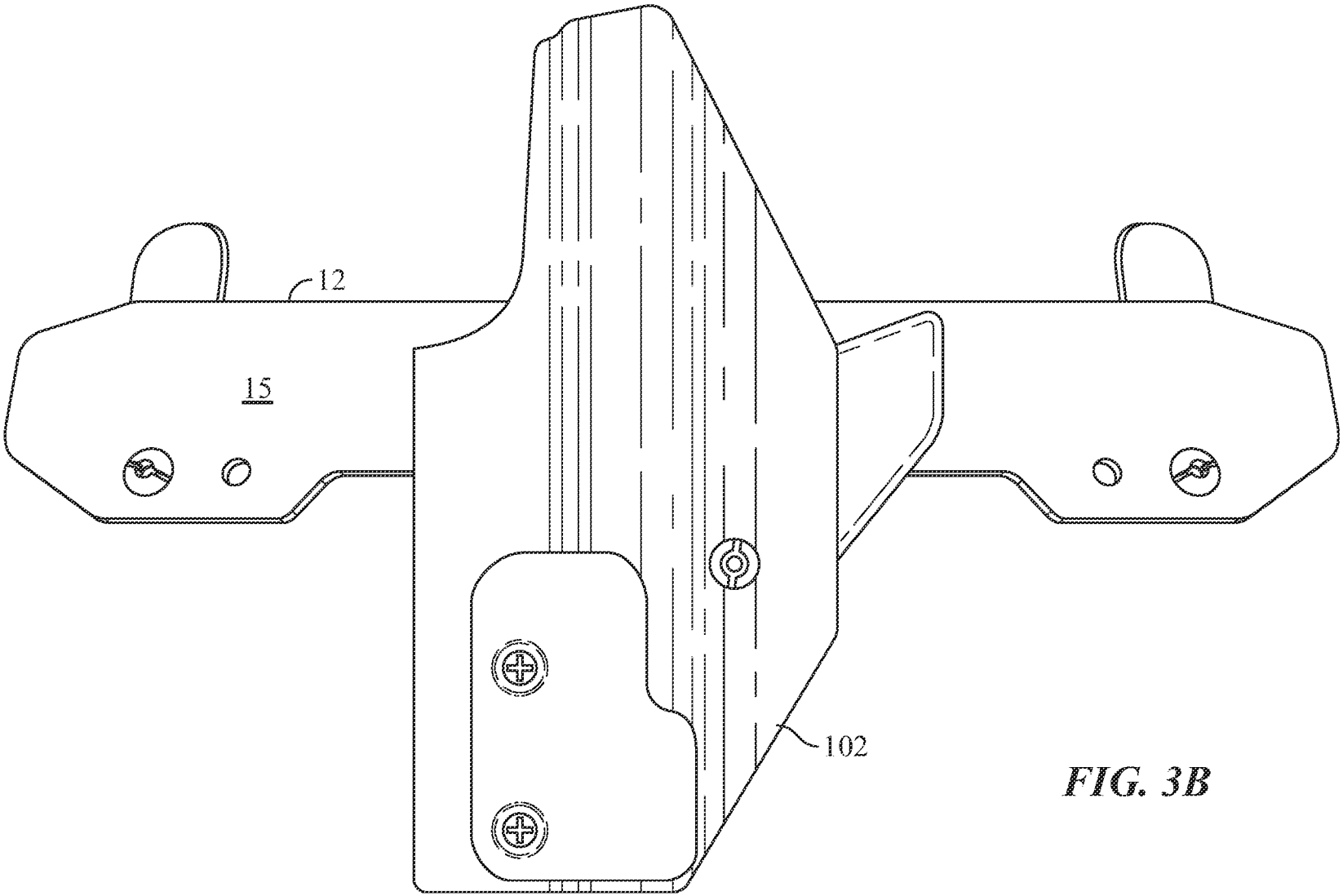
FIG. 3B illustrates an illustrative depiction of a back view of a belt device carrying a holster or sheath, according to some embodiments.

Referring to FIGS. 3A and 3B, a holster or sheath clip 100 can be attached onto (e.g., clipped onto) the third portion 22 of the belt 12. In some embodiments, the holster or sheath clip 100 can extend across the third portion 22 of the belt 22. The holster or sheath clip 100 can have one or more hooks 103 that are constructed and arranged to receive the third portion 22 of the belt 12. The one or more hooks 103 prevent the holster or sheath clip 100 from releasing the third portion 22 of the belt 12. The holster or sheath clip 100 can be constructed and arranged to clip onto a 1.5 inch wide portion of a belt or larger. A holster or sheath 102 can be fastened to the holster or sheath clip 100 by one or more fasteners 105. The holster or sheath 102 can be positioned on the second side 15 of the belt 12.

Referring to FIG. 4, the belt device 10 is shown worn by a user 110. The belt 12 can be constructed and arranged to partially wrap around a user's waist 74. In some embodiments, the belt 12 does not wrap entirely around the user's waist 74. The first clip 30 of the belt device 10 is attached onto the waistband 76 at a first location 120 on the waistband 76. The second clip 32 of the belt device 10 is attached onto the waistband 76 at a second location 121 on the waistband 76, wherein the second location 121 is different from the first location 120. The belt device 10 is positioned between the waistband 76 and the user 110 (e.g., the user's waist 74). The holster or sheath 102 can be a holster carrying a firearm 104. The first piece of material 70 protects the user 110 from edges of the first clip 30. The second piece of material 72 protects the user 110 from edges of the second clip 32.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, a belt device for carrying a holster or sheath can include a belt that is constructed and arranged to partially wrap around a user's waist; wherein: the belt has a first portion having a first width; the belt has a second portion having a second width; the belt has a third portion connecting the first portion to the second portion, the third portion having a third width; and the third width is smaller than the first width and the second width; wherein the belt device further comprises: a first clip fastened to the first portion of the belt, wherein the first clip is constructed and arranged to attach onto a waistband; a first piece of material positioned between the first clip and the belt, wherein the first piece of material is constructed and arranged to be positioned at least partially over the first clip; a second clip fastened to the second portion of the belt, wherein the second clip is constructed and arranged to attach onto the waistband; a second piece of material positioned between the second clip and the belt, wherein the second piece of material is constructed and arranged to be positioned at least partially over the second clip; and wherein the third portion is constructed and arranged to receive and support at least a holster clip.

Variation 2 may include the belt device as in variation 1, wherein the first piece of material and the second piece of material are made primarily of leather.

Variation 3 may include the belt device as in variation 1, wherein the first width is approximately 2 inches, and wherein the second width is approximately 2 inches.

Variation 4 may include the belt device as in variation 1, wherein the third width is approximately 1.5 inches.

Variation 5 may include the belt device as in variation 1, wherein the belt is made primarily of a polyester or nylon webbing coated in a polymer.

Variation 6 may include the belt device as in variation 1, wherein the belt has a textured surface facing the first clip and the second clip.

Variation 7 may include the belt device as in variation 1, wherein the first clip and the second clip are made primarily of metal.

According to variation 8 a belt device for carrying a holster or sheath may include a belt that is constructed and arranged to partially wrap around a user's waist; wherein: the belt has a first portion having a first width; the belt has a second portion having a second width; the belt has a third portion connecting the first portion to the second portion, the third portion having a third width; the third width is smaller than the first width and the second width; and wherein the belt device further comprises: a first clip fastened to the first portion of the belt, wherein the first clip is constructed and arranged to attach onto a waistband, and wherein the first clip extends above the belt by a first distance; a first piece of material positioned between the first clip and the belt, wherein the first piece of material extends above the belt by a second distance that is larger than the first distance; a second clip fastened to the second portion of the belt, wherein the second clip is constructed and arranged to attach onto the waistband; and a second piece of material positioned between the second clip and the belt; wherein the third portion is constructed and arranged to receive and support at least a holster clip.

Variation 9 may include the belt device as in variation 8, wherein the second piece of material extends above the belt by a third distance that is larger than the first distance.

Variation 10 may include the belt device as in variation 8, wherein the first piece of material and the second piece of material are made primarily of leather.

Variation 11 may include the belt device as in variation 8, wherein the first width is approximately 2 inches, and wherein the second width is approximately 2 inches.

Variation 12 may include the belt device as in variation 8, wherein the third width is approximately 1.5 inches.

Variation 13 may include the belt device as in variation 8, wherein the belt is made primarily of a polyester or nylon webbing coated in a polymer.

Variation 14 may include the belt device as in variation 8, wherein the belt has a textured surface.

Variation 15 may include the belt device as in variation 8, wherein the first clip and the second clip are made primarily of metal.

According to variation 16, a belt device for carrying a holster or sheath may include a belt that is constructed and arranged to partially wrap around a user's waist; wherein: the belt has a first portion having a first width; the belt has a second portion having a second width; the belt has a third portion connecting the first portion to the second portion, the third portion having a third width; and the third width is smaller than the first width and the second width; wherein the belt device further comprises: a first clip fastened to the first portion of the belt, wherein the first clip is constructed and arranged to attach onto a waistband, and wherein the first clip has a first height; a first piece of material positioned between the first clip and the belt, wherein the first piece of material has a second height that is larger than the first height; a second clip fastened to the second portion of the belt, wherein the second clip is constructed and arranged to attach onto the waistband; a second piece of material positioned between the second clip and the belt; and wherein the third portion is constructed and arranged to receive and support at least a holster clip.

Variation 17 may include the belt device as in variation 16, wherein the second piece of material has a third height that is larger than the first height.

Variation 18 may include the belt device as in variation 16, wherein the first piece of material and the second piece of material are made primarily of leather.

Variation 19 may include the belt device as in variation 16, wherein the belt is made primarily of a polyester or nylon webbing coated in a polymer.

Variation 20 may include the belt device as in variation 16, wherein the first clip and the second clip are made primarily of metal.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for anyone of the elements in the claims below or that a single element can be substituted for two or more elements in a claim. Although elements can be described above as acting in certain combinations, and even initially claimed as such, it is to be expressly understood that one or more elements from a claimed combination can, in some cases, be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible considering the above teachings without departing from the following claims.

What is claimed is:

1. A belt device for carrying a holster or sheath, comprising:

a belt that is constructed and arranged to partially wrap around a user's waist; wherein:

the belt has a first portion having a first width;

the belt has a second portion having a second width;

the belt has a third portion connecting the first portion to the second portion, the third portion having a third width; and the third width is smaller than the first width and the second width;

wherein the belt device further comprises:

a first clip fastened to the first portion of the belt, wherein the first clip is constructed and arranged to attach onto a waistband, and wherein the first clip extends above the belt by a first distance;

a first piece of material positioned between the first clip and the belt, wherein the first piece of material is constructed and arranged to be positioned at least partially over the first clip, and wherein the first piece of material extends above the belt by a second distance that is larger than the first distance;

a second clip fastened to the second portion of the belt, wherein the second clip is constructed and arranged to attach onto the waistband;

a second piece of material positioned between the second clip and the belt, wherein the second piece of material is constructed and arranged to be positioned at least partially over the second clip; and wherein the third portion is constructed and arranged to receive and support at least a holster clip.

2. The belt device of claim 1, wherein the first piece of material and the second piece of material are made primarily of leather.

3. The belt device of claim 1, wherein the first width is approximately 2 inches, and wherein the second width is approximately 2 inches.

4. The belt device of claim 1, wherein the third width is approximately 1.5 inches.

5. The belt device of claim 1, wherein the belt is made primarily of a polyester or nylon webbing coated in a polymer.

6. The belt device of claim 1, wherein the belt has a textured surface facing the first clip and the second clip.

7. The belt device of claim 1, wherein the first clip and the second clip are made primarily of metal.

8. A belt device for carrying a holster or sheath, comprising:

a belt that is constructed and arranged to partially wrap around a user's waist; wherein:

the belt has a first portion having a first width;

the belt has a second portion having a second width;

the belt has a third portion connecting the first portion to the second portion, the third portion having a third width;

the third width is smaller than the first width and the second width; and wherein the belt device further comprises;

a first clip fastened to the first portion of the belt, wherein the first clip is constructed and arranged to attach onto a waistband, and wherein the first clip extends above the belt by a first distance;

a first piece of material positioned between the first clip and the belt, wherein the first piece of material extends above the belt by a second distance that is larger than the first distance;

a second clip fastened to the second portion of the belt, wherein the second clip is constructed and arranged to attach onto the waistband; and a second piece of material positioned between the second clip and the belt;

wherein the third portion is constructed and arranged to receive and support at least a holster clip.

9. The belt device of claim 8, wherein the second piece of material extends above the belt by a third distance that is larger than the first distance.

10. The belt device of claim 8, wherein the first piece of material and the second piece of material are made primarily of leather.

11. The belt device of claim 8, wherein the first width is approximately 2 inches, and wherein the second width is approximately 2 inches.

12. The belt device of claim 8, wherein the third width is approximately 1.5 inches.

13. The belt device of claim 8, wherein the belt is made primarily of a polyester or nylon webbing coated in a polymer.

14. The belt device of claim 8, wherein the belt has a textured surface.

15. The belt device of claim 8, wherein the first clip and the second clip are made primarily of metal.

16. A belt device for carrying a holster or sheath, comprising:

a belt that is constructed and arranged to partially wrap around a user's waist; wherein:

the belt has a first portion having a first width;

the belt has a second portion having a second width;

the belt has a third portion connecting the first portion to the second portion, the third portion having a third width; and the third width is smaller than the first width and the second width;

wherein the belt device further comprises:

a first clip fastened to the first portion of the belt, wherein the first clip is constructed and arranged to attach onto a waistband, and wherein the first clip has a first height, and wherein the first clip extends above the belt by a first distance;

a first piece of material positioned between the first clip and the belt, wherein the first piece of material has a second height that is larger than the first height, and wherein the first piece of material extends above the belt by a second distance that is larger than the first distance;

a second clip fastened to the second portion of the belt, wherein the second clip is constructed and arranged to attach onto the waistband;

a second piece of material positioned between the second clip and the belt; and wherein the third portion is constructed and arranged to receive and support at least a holster clip.

17. The belt device of claim 16, wherein the second piece of material has a third height that is larger than the first height.

18. The belt device of claim 16, wherein the first piece of material and the second piece of material are made primarily of leather.

19. The belt device of claim 16, wherein the belt is made primarily of a polyester or nylon webbing coated in a polymer.

20. The belt device of claim 16, wherein the first clip and the second clip are made primarily of metal.

* * * * *